US006230870B1

(12) United States Patent
Levasseur et al.

(10) Patent No.: US 6,230,870 B1
(45) Date of Patent: May 15, 2001

(54) COIN DETECTION DEVICE

(75) Inventors: Joseph L. Levasseur, Chesterfield; Mark H. Leibu, St. Louis, both of MO (US)

(73) Assignee: Coin Acceptors, Inc., St. Louis, MO (US)

( * ) Notice: Subject to any disclaimer, the term of this patent is extended or adjusted under 35 U.S.C. 154(b) by 0 days.

(21) Appl. No.: 09/501,948

(22) Filed: Feb. 10, 2000

(51) Int. Cl.[7] ..... G07D 5/08; G07D 5/04
(52) U.S. Cl. ..... 194/317; 194/334
(58) Field of Search ..... 194/317, 318, 194/334, 338

(56) References Cited

U.S. PATENT DOCUMENTS

| | | | | |
|---|---|---|---|---|
| 4,151,904 | | 5/1979 | Levasseur et al. | 194/100 |
| 4,254,857 | | 3/1981 | Levasseur et al. | 194/100 |
| 4,625,852 | | 12/1986 | Hoormann | 194/317 |
| 4,646,904 | | 3/1987 | Hoormann | 194/334 |
| 4,739,869 | | 4/1988 | Hoormann | 194/317 |
| 4,763,769 | | 8/1988 | Levasseur | 194/217 |
| 4,805,754 | * | 2/1989 | Howells | 194/317 |
| 5,033,603 | | 7/1991 | Kai et al. | 194/334 |
| 5,293,979 | | 3/1994 | Levasseur | 194/317 |
| 5,337,877 | * | 8/1994 | Waite et al. | 194/317 |
| 5,341,908 | * | 8/1994 | Furneaux | 194/317 |
| 5,485,908 | | 1/1996 | Wang et al. | 194/317 |
| 5,579,887 | | 12/1996 | Leibu et al. | 194/317 |

FOREIGN PATENT DOCUMENTS

| | | | | |
|---|---|---|---|---|
| 0710933 | | 10/1995 | (EP) . | |
| 0775989 | | 10/1996 | (EP) . | |
| 2 135 095 | * | 8/1984 | (GB) | 73/163 |
| 2323199 | | 2/1997 | (GB) . | |
| 2323200 | | 2/1997 | (GB) . | |
| WO 99/23615 | | 5/1999 | (WO) . | |
| WO 99/23616 | | 5/1999 | (WO) . | |

* cited by examiner

*Primary Examiner*—Robert P. Olszewski
*Assistant Examiner*—Bryan Jaketic
(74) *Attorney, Agent, or Firm*—Haverstock, Garrett & Roberts LLP

(57) ABSTRACT

A coin detection device for determining a size of a coin traveling along a coin track comprises a first inductive sensor positioned along the coin track, a second inductive sensor positioned above the first inductive sensor, a processing circuit connected to the first and second inductive sensors, each of the sensors for providing an output signal to the processing circuit and the processing circuit determining the size of the coin based upon a ratio of the output signals.

20 Claims, 3 Drawing Sheets

COIN DETECTION DEVICE

BACKGROUND OF THE INVENTION

The present invention relates to a coin changer utilized in a vending machine which is capable of accepting and storing different coin denominations and in particular to a coin changer having a coin detection device for coin detection and discrimination.

Vending machines typically include coin changer devices for accepting coins of different denominations. These coin changer devices function to authenticate each of the coins inserted into the vending machine and to determine the denomination of each of the coins. Known coin detection devices utilize various coin detection techniques and methods which include optical size detection and metallic content or characteristic detection. Examples of two such coin detection devices are disclosed in U.S Pat. Nos. 4,625,852 and 4,646,904. In operation, a deposited coin is routed along a coin path to pass by either optical sensors or inductive sensors. The optical sensors typically include a phototransistor having a light emitting diode. As the coin rolls by the optical sensor the transmitted light produced by the light emitting diode is blocked from reaching the phototransistor by the coin and a signal representative of this event is sent to the coin changer device. This signal or the duration of this signal may be used to determine the size of the coin. The inductive sensors produce magnetic fields which interact with the coin. The characteristics of the magnetic fields are dependent upon the resistivity and permeability of the coin material as well as the coin size. The signal generated from the interaction of the coin with the magnetic field produced by the inductive sensor can be compared with predetermined unique characteristics for each coin type to be examined by the coin changer device. If the generated signal matches certain characteristics for a particular coin type, then the deposited coin is identified as being that particular coin type.

Although optical sensors and inductive sensors are useful in determining authenticity and denomination of a deposited coin, these sensors typically take up room in the coin changer device in which space is at a premium. Further, it is desirable to utilize small sensing units in vending applications for various reasons. Small sensing units are desirable for coin detection because these units may be positioned close to the coin path for greater magnetic coupling with the coin passing by the inductive sensors. Greater magnetic coupling results in higher magnitude signals being induced in the inductive sensors which results in more accurate coin type identification.

Accordingly, it is desirable and advantageous to provide a coin detection device having small sensing units which are employed to authenticate and accept coins of different denominations. Additionally, it would be advantageous to have a coin detection device which is more accurate in determining coin authenticity and denomination.

SUMMARY OF THE INVENTION

The coin detection device of the present invention is capable of determining a size of a coin traveling along a coin track with the device comprising a first inductive sensor positioned along the coin track, a second inductive sensor positioned above the first inductive sensor, a processing circuit connected to the first and second inductive sensors, each of the sensors for providing an output signal to the processing circuit and the processing circuit determining the size of the coin based upon a ratio of the output signals.

In another form of the present invention, a coin detection device for detecting a characteristic of a coin comprises a processing circuit, a first inductive device connected to the processing circuit and the first inductive element for producing a magnetic field and for providing an output signal to the processing circuit indicative of the interaction of the field with the coin, a second inductive device connected to the processing circuit, the second inductive element for producing a magnetic field and for providing an output signal to the processing circuit indicative of the interaction of the field with the coin, the first and second inductive devices being in a vertical relationship to each other, and the processing circuit for determining whether the coin is acceptable based upon a comparison of the output signals.

Another form of the present invention is a metal detector which comprises a first circuit formed of an inductive element and a second circuit formed of an inductive element, the first and second circuits being connected to a processing circuit, the inductive elements being in a vertical relationship to each other, the first and second circuits each providing an output signal to the processing circuit, the output signals being produced by the presence of a metallic object and the processing circuit for detecting a characteristic of the metallic object based upon a ratio of the output signals.

Accordingly, it is an object of the present invention to provide a coin detection device which is capable of detecting coins and other metallic objects.

It is another object of the present invention to provide a coin detection device which is of a compact design.

It is a further object of the present invention to provide a coin detection device which can be used to distinguish between a number of different denomination coins without the need for replicative circuitry.

Another object of the present invention is to provide a coin detection device which utilizes magnetic size detection to effectively distinguish between different coin types and coins of similar metallic content.

A further object of the present invention is to provide a coin detection device which is usable with other coin detection and validation devices.

Another object of the present invention is to provide a coin detection device for use in coin operated vending systems for distinguishing between acceptable coins and unacceptable coins deposited by customers.

A still further object of the present invention is to provide a coin detection device for identifying undesired and counterfeit coins, tokens, slugs, and non-coin objects, and for also determining and aiding in the determination of denomination of acceptable coins.

Another object of the present invention is to provide a relatively inexpensive yet accurate coin detection device for sensing certain movements of objects such as coins and for distinguishing counterfeit objects or coins from genuine coins and for identifying the denominations of each acceptable coin.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
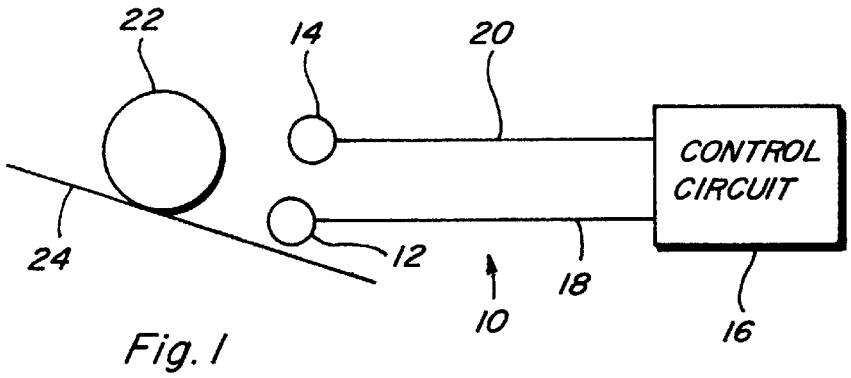
FIG. 1 is a partial perspective view of a coin detector device constructed according to the present invention.

Referring now to the drawings, wherein like numerals refer to like items, number 10 identifies a preferred embodiment of the coin detection device constructed according to the present invention. With reference now to FIG. 1, the coin detection device 10 has a first coin sensing circuit or device 12 and a second coin sensing circuit or device 14. The first and second coin sensing devices 12 and 14 are connected to a processing or control circuit 16 via electrical connections 18 and 20, respectively. The electrical connections 18 and 20 are shown as single wires in FIG. 1, however, it is possible that such wires may be two or more. The coin detection device 10 is typically installed for use in a vending machine or like device. A coin 22 may be deposited into the coin detection device 10 and allowed to roll down an upper inclined surface, such as a coin track or rail 24, to pass by or in front of the first and second coin sensing devices 12 and 14. The coin sensing devices 12 and 14 may be inductive elements which each produce an electromagnetic field which is capable of interacting with the coin 22. The coin detection device 10 is used to determine whether the deposited coin 22 is acceptable or genuine and what the denomination of the coin 22 is. Examples of the control circuit 16 for use in the present coin detection device 10 are disclosed in U.S. Pat. Nos. 4,625,852, 4,646,904, 4,739,869, 4,763,769, and 5,293,979, all of which are assigned to the assignee of the present invention.

The coin sensing devices 12 and 14 are positioned on one side of the coin track 24 and are in a vertical relationship to each other. The coin sensing devices 12 and 14 are positioned in such a manner that the coin 22 passing in front of each of the coin sensing devices 12 and 14 will interact with each electromagnetic field generated by the devices 12 and 14. The interactions between each of the devices 12 and 14 and the coin 22 will be sent as signals over the wires 18 and 20 to the control circuit 16. The control circuit 16 is capable of using such signals to determine characteristics of the coin 22. For example, the signals may be used to determine the size or diameter of the coin 22 and the metallic content of the coin 22 in order to authenticate the coin 22. The coin sensing devices 12 and 14 are shown to be the same size or diameter. Some other examples of the coin sensing devices 12 and 14 are disclosed in the above list of U.S. Patents. In particular, the coin sensing devices 12 and 14 may each take the form of a coil or a tank circuit including an inductor in parallel with a capacitor. It is also possible that the coin sensing device 12 may take one form, such as a coil, while the other coin sensing device 14 may take another form, such as a tank circuit.

Figure 3:
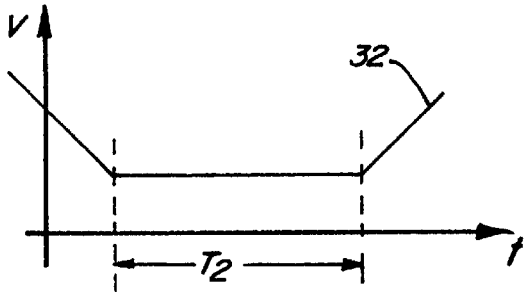
FIG. 3 is a graph of an output from another of the coin sensing devices of the coin detector device shown in FIG. 1.
Figure 2:
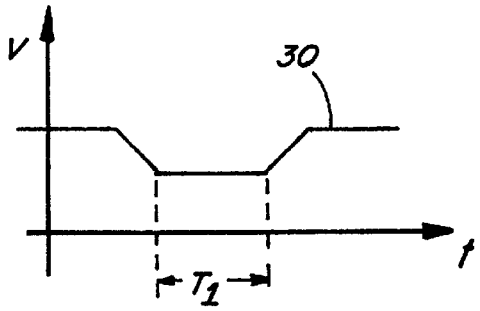
FIG. 2 is a graph of an output from one of the coin sensing devices of the coin detector device shown in FIG. 1.

Referring now to FIG. 2, a graph of a signal 30 is shown which is an example of the signal which is provided over the wire 18 to the control circuit 16. Within the signal 30 is a time period $T_1$ which represents the time the coin 22 is in front of or interacting with the coin sensing device 12. Additionally, $T_1$ is indicative of a chord of the coin 22. FIG. 3 depicts an example of a signal 32 which is sent over the wire 20 to the control circuit 16. A time period $T_2$ is shown to represent the time the coin 22 is in front of or interacting with the coin sensing device 14. $T_2$ is representative of another chord of the coin 22 which passes by the coin sensing device 14. The diameter of the coin 22 undergoing testing is derived by the relationships of the two chords as the coin travels or rolls pass the two vertically positioned coin sensing devices 12 and 14. In order to determine the size or diameter of the coin 22, the control circuit 16 determines the ratio of $T_1/T_2$. From this ratio the control circuit 16 is able to determine the diameter of the coin 22. Additionally, the control circuit 16 may evaluate the ratio in comparison with predetermined maximum and minimum ratios stored in memory within the control circuit 16. The metallic content of the coin 22 may be determined by the interaction of the coin 22 with either or both of the coin sensing devices 12 and 14. Examples of metallic content determination or discrimination are disclosed in U.S. Pat. Nos. 4,625,852, 4,646,904, 4,739,869, 4,763,769, and 5,293,979, all of which are assigned to the assignee of the present invention.

Figure 4:
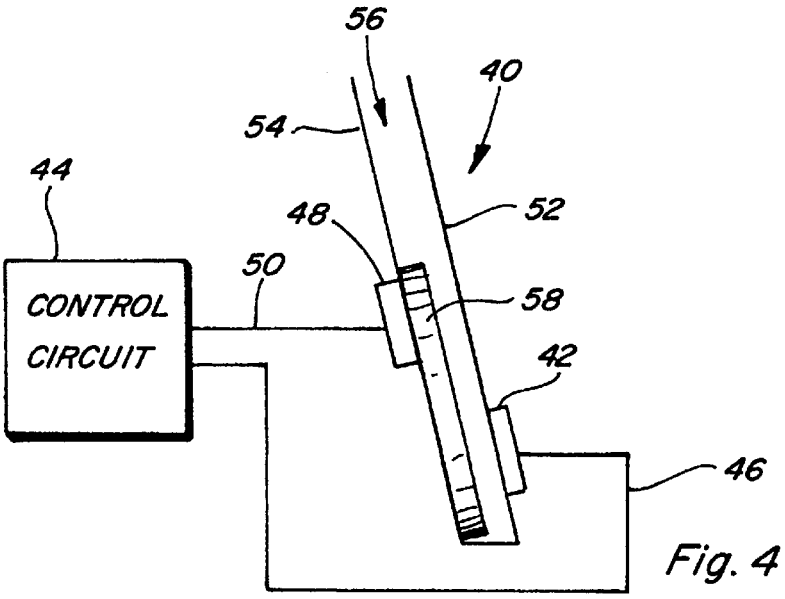
FIG. 4 is another preferred embodiment of a coin detector device constructed according to the present invention.

FIG. 4 shows another embodiment of a coin detection device 40 of the present invention. The coin detection device 40 includes a first coin sensing device 42 which is connected to a control circuit 44 via a lead 46. A second coin sensing device 48 is also connected to the control circuit 44 by a wire 50. The first and second coin sensing devices 42 and 48 are spaced in a vertical relationship with respect to each other on opposite sides 52 and 54 of a coin track 56. A coin 58 is capable of rolling pass both of the coin sensing devices 42 and 48 and signals, such as signals 30 and 32, are produced by the coin sensing devices 42 and 48 to be sent to the control circuit 44 for processing. The coin sensing devices 42 and 48 are positioned in such a manner that the coin 58 passing in front of each of the coin sensing devices 42 and 48 will interact with each electromagnetic field generated by the devices 42 and 48. The signals generated by the coin 58 rolling pass the devices 42 and 48 are used to determine the size or diameter of the coin 58 and the metallic content of the coin 58 in order to authenticate the coin 58.

Figure 5:
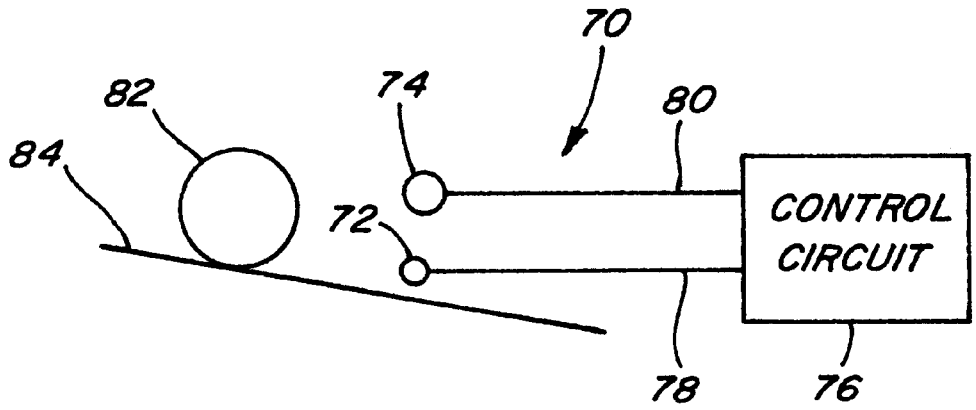
FIG. 5 is still another preferred embodiment of a coin detector device constructed according to the present invention.

With reference now to FIG. 5, another embodiment of a coin detection device 70 is illustrated. The coin detection device 70 has a first coin sensing device 72 and a second coin sensing device 74 with the device 74 being larger in size, diameter, or dimension than the device 72. The devices 72 and 74 are also in a vertical relationship with the larger device 74 being above the device 72. The first coin sensing device 72 is connected to a control circuit 76 by a wire 78. Additionally, the second coin sensing device 74 is connected to the control circuit 76 via a wire 80. A coin 82 is capable of traveling down a coin track 84 in front of the coin sensing devices 72 and 74 to interact with electromagnetic fields generated by the devices 72 and 74. Signals are produced based upon the interaction of the coin 82 and the fields of the devices 72 and 74. These signals are provided to the control circuit 76 over the wires 78 and 80. The control circuit 76 uses these signals to determine the diameter of the coin 82, as was explained above. Additionally, the control circuit 76 may use the signals to determine the metallic content of the coin 82. It is also possible to having the coin sensing devices 72 and 74 on opposite sides of the coin track 84.

Figure 6:
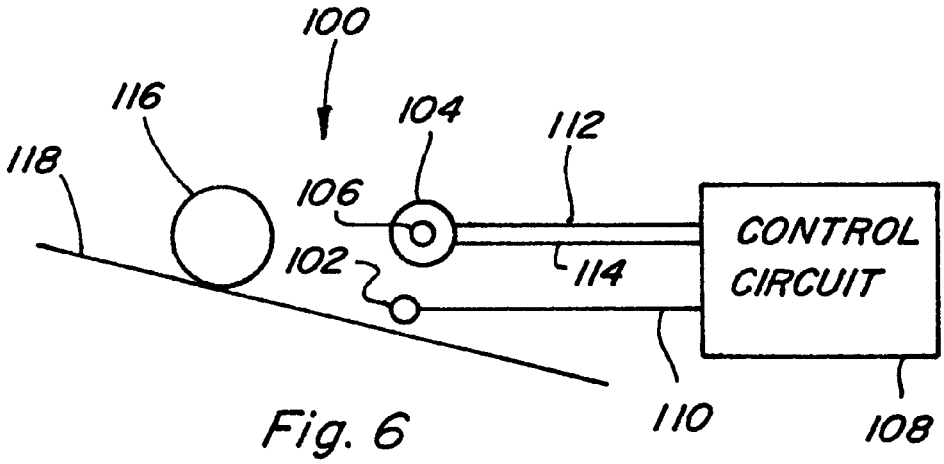
FIG. 6 is a further preferred embodiment of a coin detector device constructed according to the present invention.

FIG. 6 illustrates another preferred embodiment of a coin detection device 100 constructed according to the present invention. The coin detection device 100 comprises a first coin sensing device 102 and a second coin sensing device 104. The coin detection device 100 further comprises an optical sensor 106 incorporated with the second coin sensing device 104. An example of an optical sensor incorporated with a coin sensing device is disclosed in U.S. Pat. No. 5,662,205, which is assigned to the assignee of this application. The first coin sensing device 102 is connected to a control circuit 108 via a lead 110. The second coin sensing device 104 is connected to the control circuit 108 by a lead 112 and the optical sensor 106 is also connected to the control circuit 108 via a lead 114. The first and second coin sensing devices 102 and 104 are shown to be in a vertical relationship with one another. Also, the optical sensor 106 and the first coin sensing device 102 are in a vertical orientation.

Figure 7:
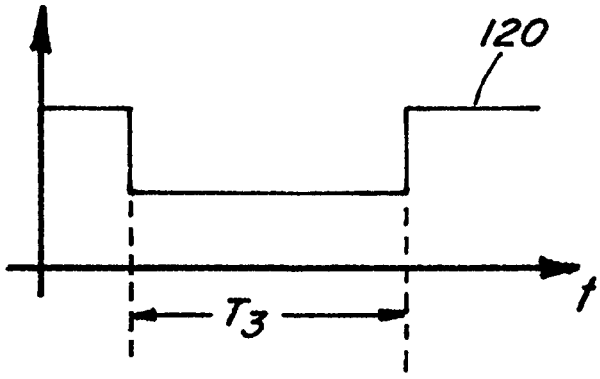
FIG. 7 is a graph of an output from an optical sensor of the coin detector device shown in FIG. 6.

Signals are produced over the leads 110, 112, and 114 whenever a coin 116 rolls down a coin track 118 pass the sensing devices 102 and 104 and the sensor 106. An example of a signal 120 which is generated by the coin 116 passing by the optical sensor 106 is shown in FIG. 7. The length that the signal 120 indicates that the coin 116 is passing by is a time period $T_3$ which is the duration of time that the chord of the coin 116 blocks the optical sensor 106. The control circuit 108 receives the signal 120 and utilizes this signal 120 to establish an optical size time which may be $T_3$. The signals received from the devices 102 and 104 may correspond to the previously defined periods $T_1$ and $T_2$ and may be used to determine a magnetic size time. The control circuit 108 is also capable of determining a magnetic to optical size ratio by either dividing $T_1$ by $T_3$ or $T_2$ by $T_3$. Either or both of these magnetic to optical size ratios may be compared to predetermined maximum and minimum ratios to determine the authenticity and/or denomination of the coin 116. If the established magnetic to optical size ratio falls between the predetermined maximum and minimum ratios for a particular valid coin type then the coin being tested is accepted as satisfying the magnetic to optical size ratio for that particular coin type.

The coin detection device 100 utilizes what has been defined or termed a magnetic to optical size ratio to distinguish between different coins and between valid coins and counterfeit coins. However, it is to be understood that the reciprocal of the magnetic to optical size ratio could be employed to determine coin authenticity or denomination. In such case the ratio would be appropriately termed an optical to magnetic size ratio. Additionally, the coin detection device 100 was illustrated to have the first coin sensing device 102 being smaller in size than the second coin sensing device 104. As can be appreciated, the first coin sensing device 102 may be the same size as the second coin sensing device 104. The first coin sensing device 102 may even be larger in size than the second coin sensing device 104. The coin sensing device 102 may be constructed to include the optical sensor 106. Further, the coin sensing devices 102 and 104 may be on the same or opposite sides of the coin track 118.

Figure 8:
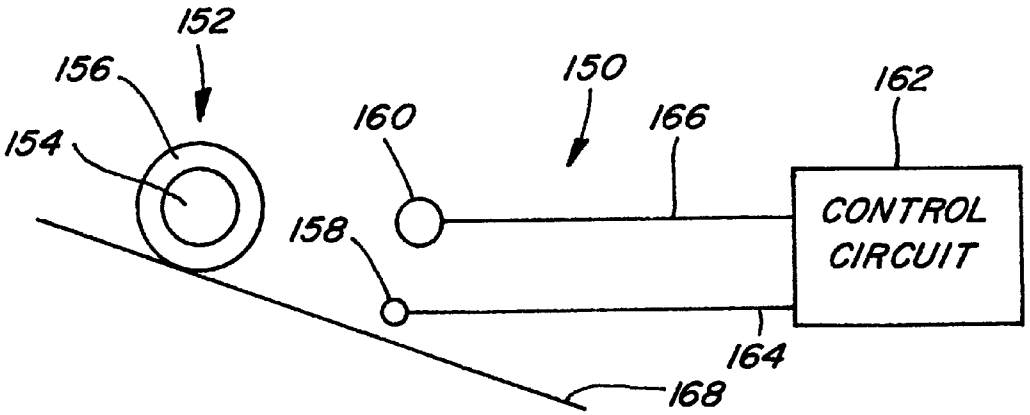
FIG. 8 is another preferred embodiment of a coin detector device constructed according to the present invention which is used to detect a ringed coin.

FIG. 8 shows another preferred embodiment of a coin detection device 150 which may be used to detect a coin 152 which has a ringed construction. The coin 152 may include an inner portion 154 formed of copper and an outer portion 156 formed of nickel. Other constructions of ringed type coins are known and the particular construction of the coin 152 is for purposes of example. The coin detection device 150 includes a first coin sensing device 158 and a second coin sensing device 160 which are in a vertical relationship to each other. The first coin sensing device 158 is smaller in size than the second coin sensing device 160. The devices 158 and 160 are connected to a control circuit 162 via leads 164 and 166, respectively. The ringed coin 152 is capable of traveling down a coin track 168 to simultaneously pass in front of the coin sensing devices 158 and 160. The coin sensing devices 158 and 160 are shown positioned on the same side of the track 168.

Figure 9:
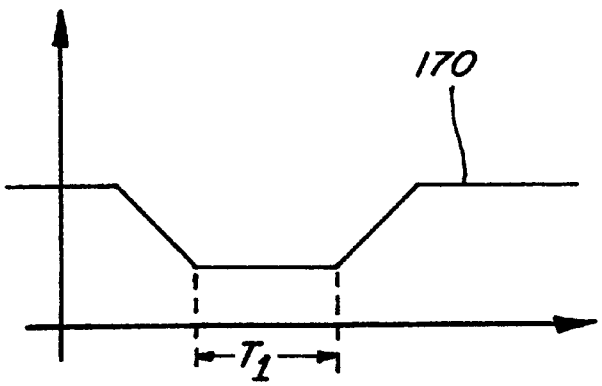
FIG. 9 is a graph of an output from one of the coin sensing devices of the coin detector device shown in FIG. 8.
Figure 10:
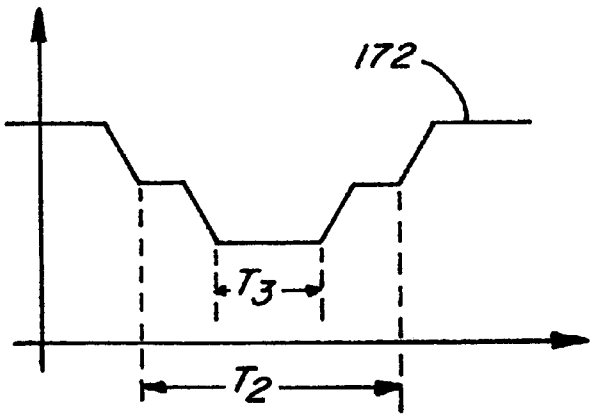
FIG. 10 is a graph of an output from another of the coin sensing devices of the coin detector device shown in FIG. 8.

Due to the ringed construction of the coin 152. the portions 154 and 156 will interact with the coin sensing devices 158 and 160 differently. With reference now to FIG. 9, the portion 154 will interact with the device 158 and a signal 170 will be produced and provided to the control circuit 162. A time period $T_1$ is shown to represent the time the portion 154 of the coin 152 is in front of or interacting with the coin sensing device 158. $T_1$ is representative of a chord of the coin 152 which passes by the coin sensing device 158. Referring now to FIG. 10, the portion 156 will interact with the device 160 and produce a signal 172 which is provided to the control circuit 162. Again, because of the ringed construction of the coin 152 both of the portions 154 and 156 will interact with the device 160. Within the signal 172 is a time period $T_2$ which is representative of the time the portion 154 is interacting with the coin sensing device 160. Additionally, within the signal 172 there is another time period $T_3$ which represents the period of time the portion 156 is interacting with the coin sensing device 160. These three time periods are used by the control circuit 162 to determine the size and metallic content of the coin 152. For example, a first magnetic size ratio is developed by dividing $T_1$ by $T_2$, a second magnetic size ratio is determined by dividing $T_1$ by $T_3$, and a third magnetic size ratio may be calculated by dividing $T_2$ by $T_3$. The control circuit 162 may use these three magnetic size ratios to determine the denomination and authenticity of the coin 152. Additionally, these three magnetic size ratios allow the control circuit 162 to determine the construction or composition of the ringed coin 152.

Although the coin detecting device 150 has been shown and discussed as having the first coin sensing device 158 being smaller than the second coin sensing device 160, it is also possible and contemplated to having the devices 158 and 160 the same size or the first coin sensing device 158 larger than the second coin sensing device 160. Additionally, the devices 158 and 160 may be positioned on opposite sides of the track 168. Further, one of the devices 158 or 160 may have incorporated therein an optical sensor which will be used to generate an optical size signal which may be used to determine or verify the size of the coin 152.

From all that has been said, it will be clear that there has thus been shown and described herein a coin detection device which fulfills the various objects and advantages sought therefor. It will be apparent to those skilled in the art, however, that many changes, modifications, variations, and other uses of the subject coin detection device are possible and contemplated. All changes, modifications, variations, and other uses and applications which do not depart from the spirit and scope of the invention are deemed to be covered by the invention, which is limited only by the claims which follow.

What is claimed is:

1. A coin detection device for determining a size of a coin traveling along a coin track, the device comprising a first inductive sensor positioned along the coin track, a second inductive sensor positioned above the first inductive sensor, a processing circuit connected to the first and second inductive sensors, each of the sensors for providing an output signal to the processing circuit and the processing circuit determining the size of the coin based upon a ratio of the output signals.

2. The coin detection device of claim 1 wherein the first inductive sensor is a coil having a first size and the second inductive sensor is a coil having a second size.

3. The coin detection device of claim 2 wherein the first size is the same size as the second size.

4. The coin detection device of claim 2 wherein the first size is larger than the second size.

5. The coin detection device of claim 2 wherein the first inductive sensor is positioned on one side of the coin track and the second inductive sensor is positioned on the other side of the coin track.

6. The coin detection device of claim 1 further comprising an optical sensor incorporated with the first inductive sensor, the optical sensor being connected to the processing circuit, the optical sensor providing a signal to the processing circuit indicative of a chord of the coin passing by the optical sensor.

7. The coin detection device of claim 1 further comprising an optical sensor incorporated within the second inductive sensor, the optical sensor being in a vertical relationship with the first inductive sensor.

8. A coin detection device for detecting a characteristic of a coin, the device comprising a processing circuit, a first inductive device connected to the processing circuit and the first inductive device for producing a magnetic field and for providing an output signal to the processing circuit indicative of the interaction of the field with the coin, a second inductive device connected to the processing circuit, the second inductive device for producing a magnetic field and for providing an output signal to the processing circuit indicative of the interaction of the field with the coin, the first and second inductive devices being in a vertical relationship to each other, and the processing circuit for determining whether the coin is acceptable based upon a comparison of the output signals.

9. The coin detection device of claim 8 wherein the first inductive device is a coil having a first size and the second inductive device is a coil having a second size.

10. The coin detection device of claim 9 wherein the first size is the same size as the second size.

11. The coin detection device of claim 9 wherein the first size is larger than the second size.

12. The coin detection device of claim 9 wherein the first size is smaller than the second size.

13. The coin detection device of claim 8 further comprising an optical sensor incorporated with the first inductive device, the optical sensor being connected to the processing circuit, the optical sensor providing a signal to the processing circuit indicative of a chord of the coin passing by the optical sensor.

14. The coin detection device of claim 8 wherein the output signal provided by the first inductive device is indicative of a first chord of the coin and the output signal provided by the second inductive device is indicative of a second chord of the coin, the processing circuit for determining the diameter of the coin based on a ratio of the first chord to the second chord.

15. A metal detector comprising a first circuit formed of an inductive element and a second circuit formed of an inductive element, the first and second circuits being connected to a processing circuit, the inductive elements being in a vertical relationship to each other, the first and second circuits each providing an output signal to the processing circuit, the output signals being produced by the presence of a metallic object and the processing circuit for detecting a characteristic of the metallic object based upon a ratio of the output signals.

16. The metal detector of claim 15 wherein each of the inductive elements is a tank circuit.

17. The metal detector of claim 15 wherein the first circuit is smaller than the second circuit.

18. The metal detector of claim 15 wherein the first circuit and the second circuit are of the same size.

19. The metal detector of claim 15 wherein the second circuit further comprises an optical sensor incorporated therein, the optical sensor being connected to the processing circuit, the optical sensor providing a signal to the processing circuit indicative of a chord of the metallic object.

20. The coin detection device of claim 19 wherein the optical sensor is in a vertical orientation with the first circuit.

* * * * *